US009975696B2

(12) United States Patent
Johnson

(10) Patent No.: US 9,975,696 B2
(45) Date of Patent: May 22, 2018

(54) GARBAGE REMOVER HELPER

(71) Applicant: Letricia Dianne Johnson, Brooklyn, NY (US)

(72) Inventor: Letricia Dianne Johnson, Brooklyn, NY (US)

(73) Assignee: Letricia Diahne Johnson, Brooklyn, NY (US)

( * ) Notice: Subject to any disclaimer, the term of this patent is extended or adjusted under 35 U.S.C. 154(b) by 0 days. days.

(21) Appl. No.: 14/838,104

(22) Filed: Nov. 9, 2015

(65) Prior Publication Data

US 2018/0065803 A1 Mar. 8, 2018

(51) Int. Cl.
*B65F 1/16* (2006.01)
*B65F 1/14* (2006.01)

(52) U.S. Cl.
CPC ..... *B65F 1/1615* (2013.01); *B65F 1/1473* (2013.01); *B65F 1/1484* (2013.01); *B65F 1/1623* (2013.01)

(58) Field of Classification Search
CPC ..... B66C 19/02; B66C 19/007; B66C 23/46; B65F 1/1615
See application file for complete search history.

(56) References Cited

U.S. PATENT DOCUMENTS 2,661,921 A * 12/1953 Brustein ..... A47J 47/16 248/147
2,865,590 A * 12/1958 Greenwell ..... B65F 1/1421 220/816
5,028,196 A * 7/1991 Richards ..... B65F 1/14 414/406

* cited by examiner

*Primary Examiner* — John D Walters
*Assistant Examiner* — James J Triggs
(74) *Attorney, Agent, or Firm* — Tarley Stevenson; Stevenson IP, LLC

(57) ABSTRACT

The garbage bin device provides a lid section that can be totally unlatched from the bottom section, along with an overlap of the bottom section to avoid closing difficulties and to limit odor emanation. Pivoting handles are positioned to provide for balancing the device. A bottom opening with accordion door and t-handle operation provides for emptying the bin device as desired, whether through lid top or bottom side. A gable and arched top also provide for additional clearance for taller items. An indicia is provided for the lid section lid front, whether user or distributor supplied. A rear top overlap further protects against odor emanation. Latches assist in preventing animal invasion.

2 Claims, 6 Drawing Sheets

(Front View)

(Front View)

(Rear View)

(Bottom View)

(Cross-sectional View)

(Side View)

(Bottom View)

GARBAGE REMOVER HELPER

BACKGROUND OF THE INVENTION

While various types of garbage bins are known in the prior art, none have succeeded in solving all of the problems known to such bins. Many have wheels that are set outwardly from the bottom and do not navigate easily and correctly. Moreover, many garbage bins do not properly close and offer exuding refuse fumes that are not only offensive but attract various animals. Those garbage bins that do close and latch are typically very large, heavy, padlocked, and impossible to move without a truck or machine. Those that are more easily movable often do not have handles for ease of movement or allow a user access only through a large lid. The present garbage bin device solves these problems.

FIELD OF THE INVENTION

The present garbage bin device relates to garbage bins, and more particularly, to a personal garbage bin device that solves the existing problems of garbage bins.

SUMMARY OF THE INVENTION

The general purpose of the garbage bin device, described subsequently in greater detail, is to provide a garbage bin device that has many novel features that result in a garbage bin device which is not anticipated, rendered obvious, suggested, or even implied by prior art, either alone or in combination thereof.

To accomplish this, the garbage bin device comprises a bottom section having a front side spaced apart from a back side, a left side spaced apart from a right side, a top side spaced apart from a bottom side, and a pair of spaced apart rounded corners. Each of the pair of rounded corners is disposed proximal each of the front side and the bottom side. The rounded corners specifically enable a user to easily tilt the garbage bin device forward as desired. A pair of spaced apart wheel recesses is also provided. A first wheel recess is disposed proximal each of the bottom side, the back side, and the right side, and a second wheel recess is disposed proximal each of the bottom side, the back side, and the left side. A wheel is disposed in each wheel recess. Recessing the wheels allows for the garbage bin device to be transported without the wheels catching on various objects and doorways, a problem that commonly occurs during the transport of most garbage bins on the market today. Furthermore, each wheel protrudes beyond the back side so that the garbage bin device can be easily tilted backwards and forwards.

A pivoting handle is disposed on each of the left side and the right side. Each pivoting handle is disposed more proximal the top side than the bottom side. Such positioning of the handles allows a user to more easily balance the garbage bin device as needed, especially when loaded. A bottom opening is disposed in the bottom side and provides a bottom side access that is not available in other garbage bins. An L-shaped channel is disposed around the bottom opening and is extended upwardly within the back side. A rounded section is disposed within the L-shaped channel between the back side and the bottom side. An accordion door is slidably disposed within the L-shaped channel. A handle slot is disposed vertically within the back side proximal the bottom side and upwardly therefrom. A t-handle pivotally connects within the handle slot to the accordion door. The t-handle is disposed within the back side. A pair of handle hooks is disposed above the handle slot. The pair of handle hooks is in selective receipt of the t-handle and hold the accordion door open as desired.

A lid section is disposed atop the bottom section. The lid section has a lid top spaced apart from a lid bottom, a lid front spaced apart from a lid back, a lid left side spaced apart from a lid right side, a lid overlap extended beyond the bottom section, and a lifting platform disposed above the front side. The lifting platform is disposed more outwardly than the overlap is from the bottom section. At least one latch selectively secures the lid bottom to the top side. A front riser is spaced apart from a curved rear riser, with each of the front riser and the rear riser disposed above the lid bottom. Additionally, the front riser is disposed above the front side, and the rear riser is disposed above the back side. A front slant is disposed upon the front riser, with the front slant angled to the lid back and the lid top. The front slant has a frame with an indicium within. The indicium can be installed by a manufacturer, distributor, and a user of the device. A front gable is disposed upon the front slant and the lid front. A pivoting handle is disposed atop the front gable. The handle disposed atop the front gable provides a user with the option to lift both the entire device and only the lid section. A rear slant is disposed atop the curved rear riser, with the rear slant meeting the front slant at the lid top. A rear top is disposed atop the rear slant. The rear top is hingedly attached to the front slant at the lid top. The rear top has a rear top overlap disposed over the rear slant. At least one latch selectively secures the rear top to the rear slant. The design of the top section allows a user to place much taller refuse within the garbage bin device than would otherwise be allowed.

Since the wheels contact only when the device is tilted toward the back side, they do not interfere with the garbage bin device's stability when it is standing upright. The lid section overlaps the top side. The rear top overlaps the rear slant, and the latches hold both the top section and the lid section together to prohibit odors from emanating.

Thus has been broadly outlined the more important features of the present garbage bin device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
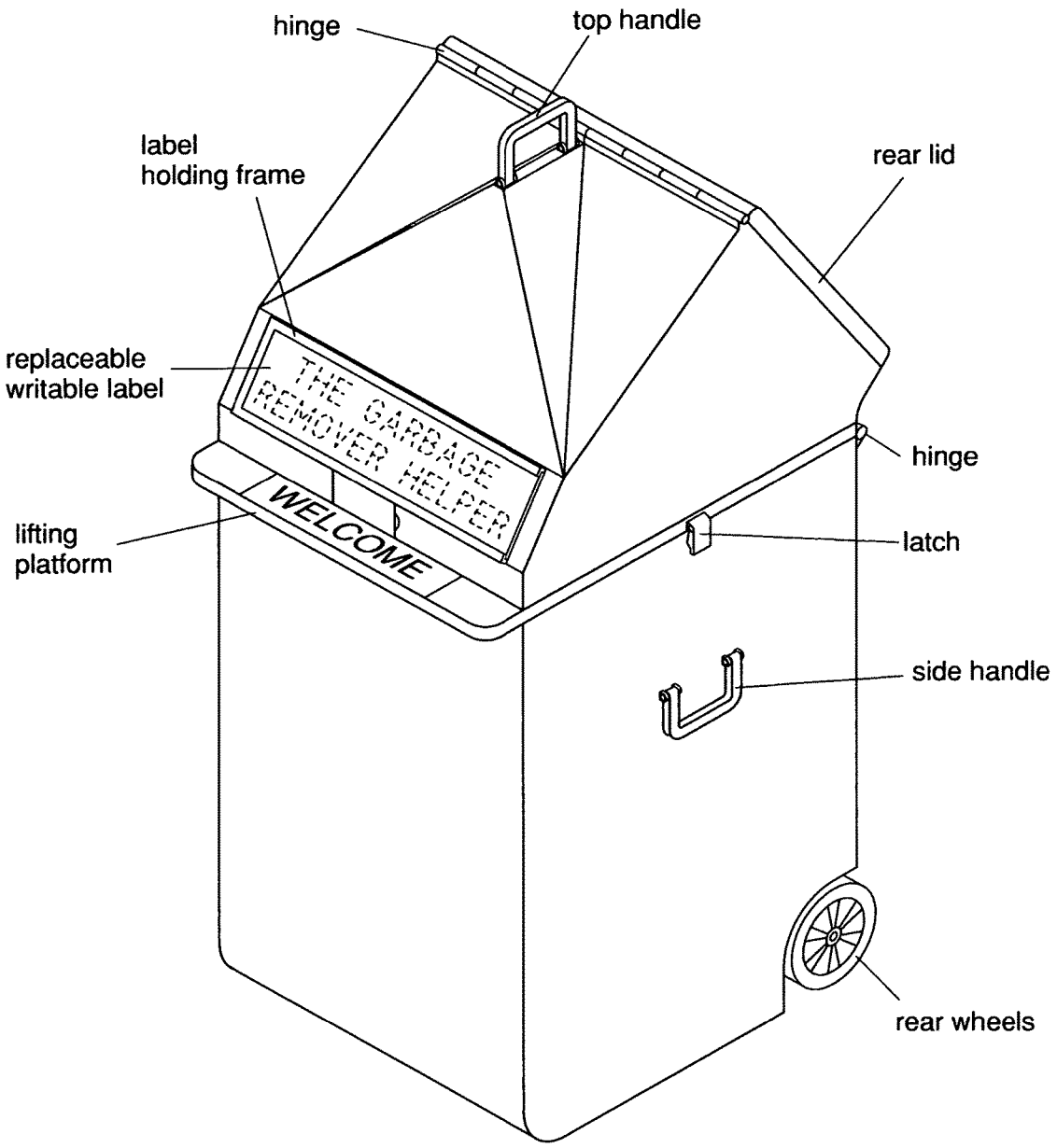
FIG. 1 is a front side right side perspective view of a garbage bin device.
Figure 2:
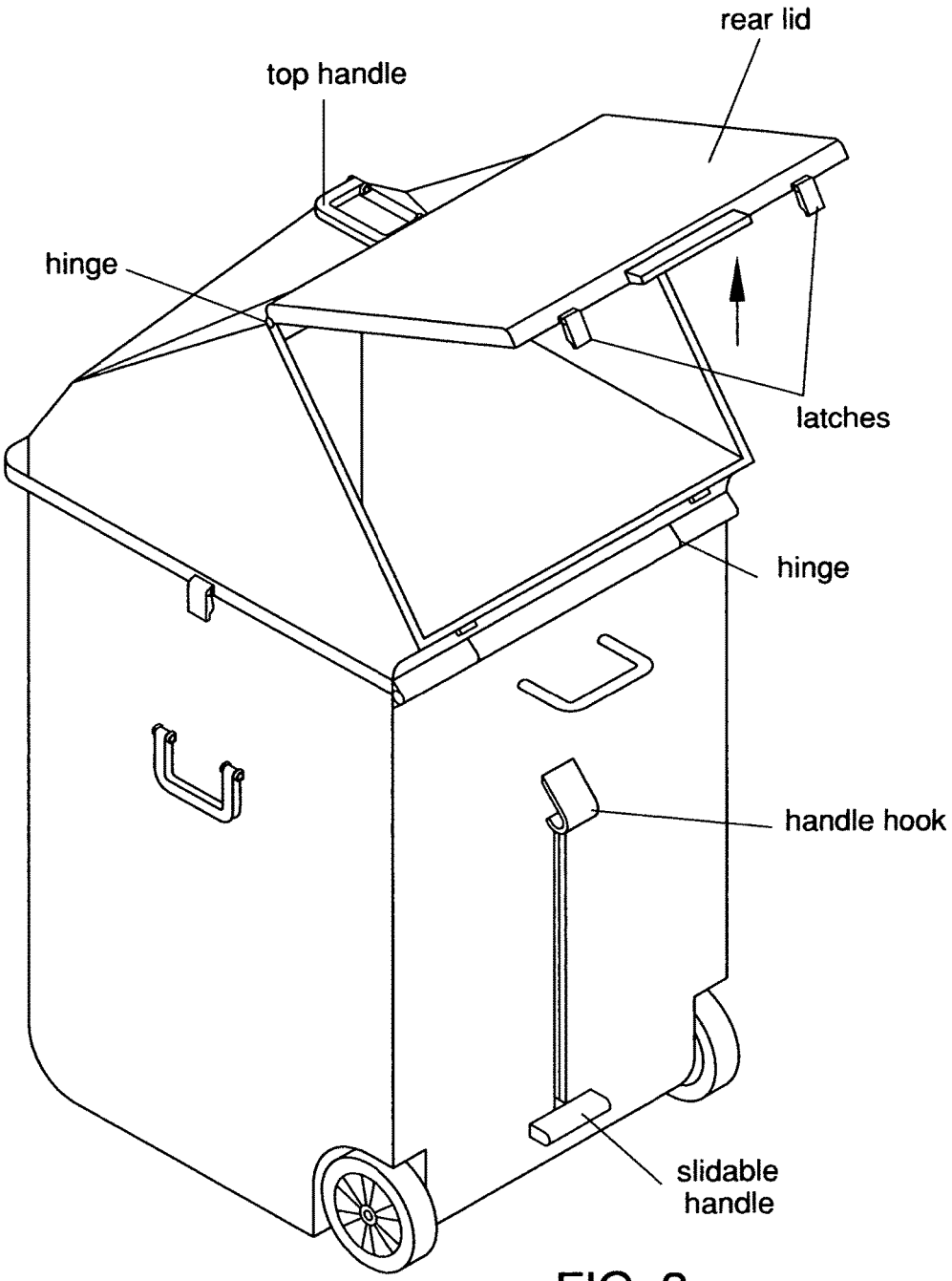
FIG. 2 is a rear side right side perspective view.
Figure 3:
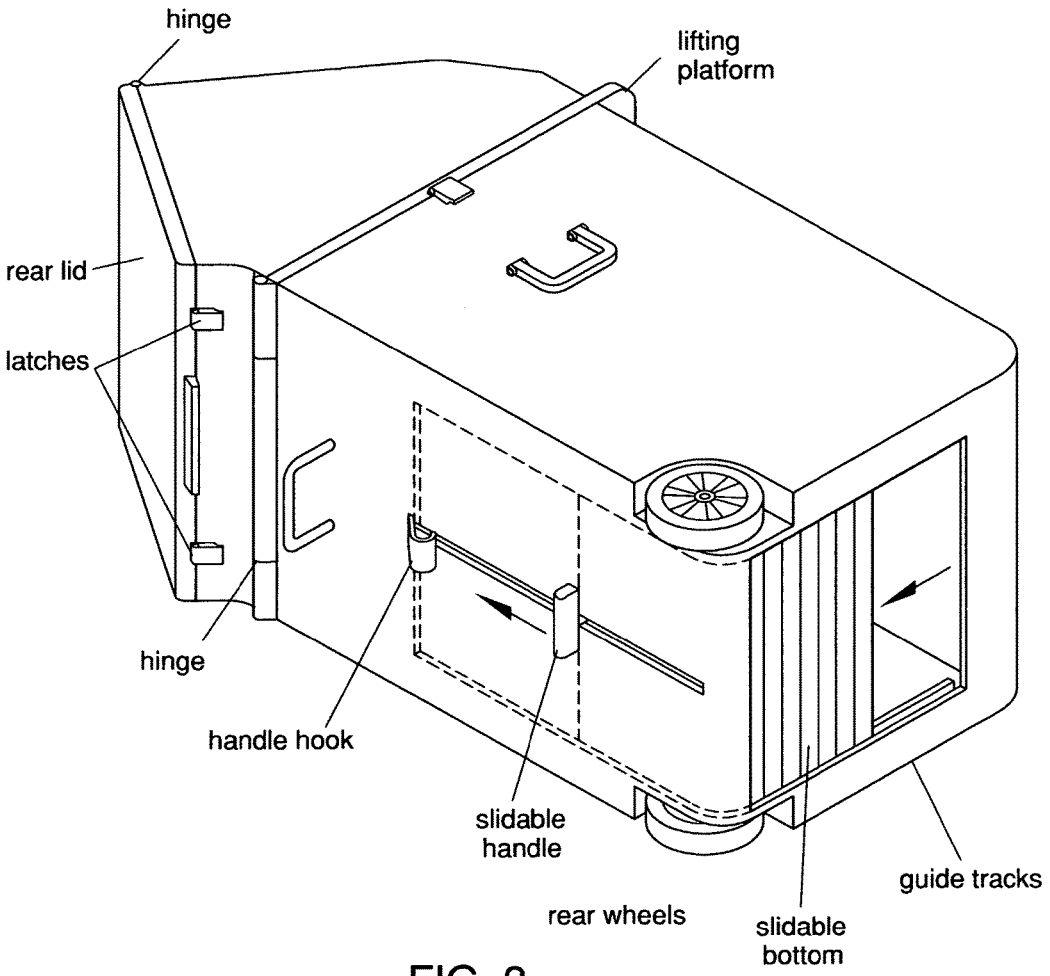
FIG. 3 is a bottom side left side perspective view with an accordion door partially opened.
Figure 4:
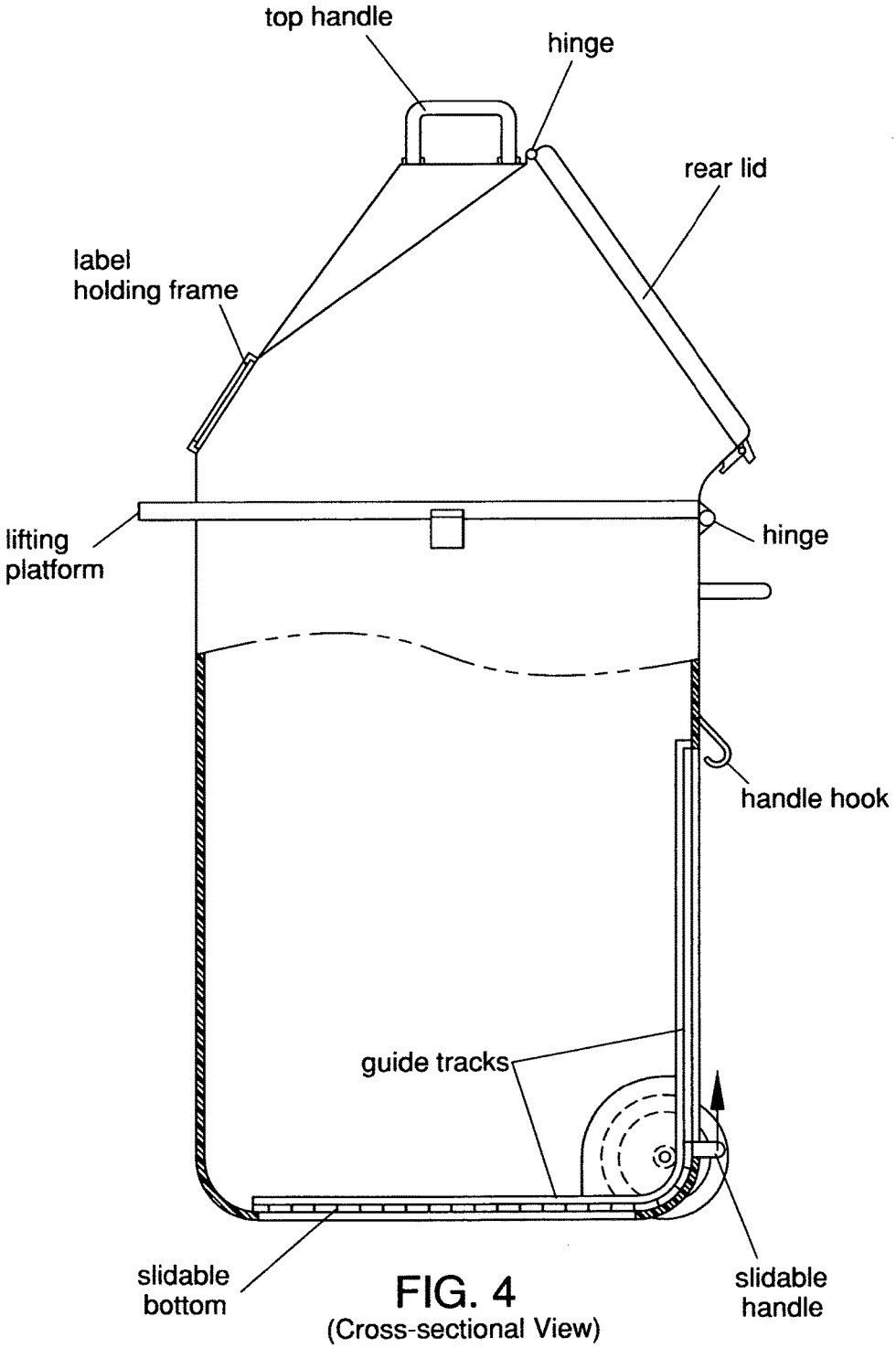
FIG. 4 is a partial cutaway right side elevation view.
Figure 5:
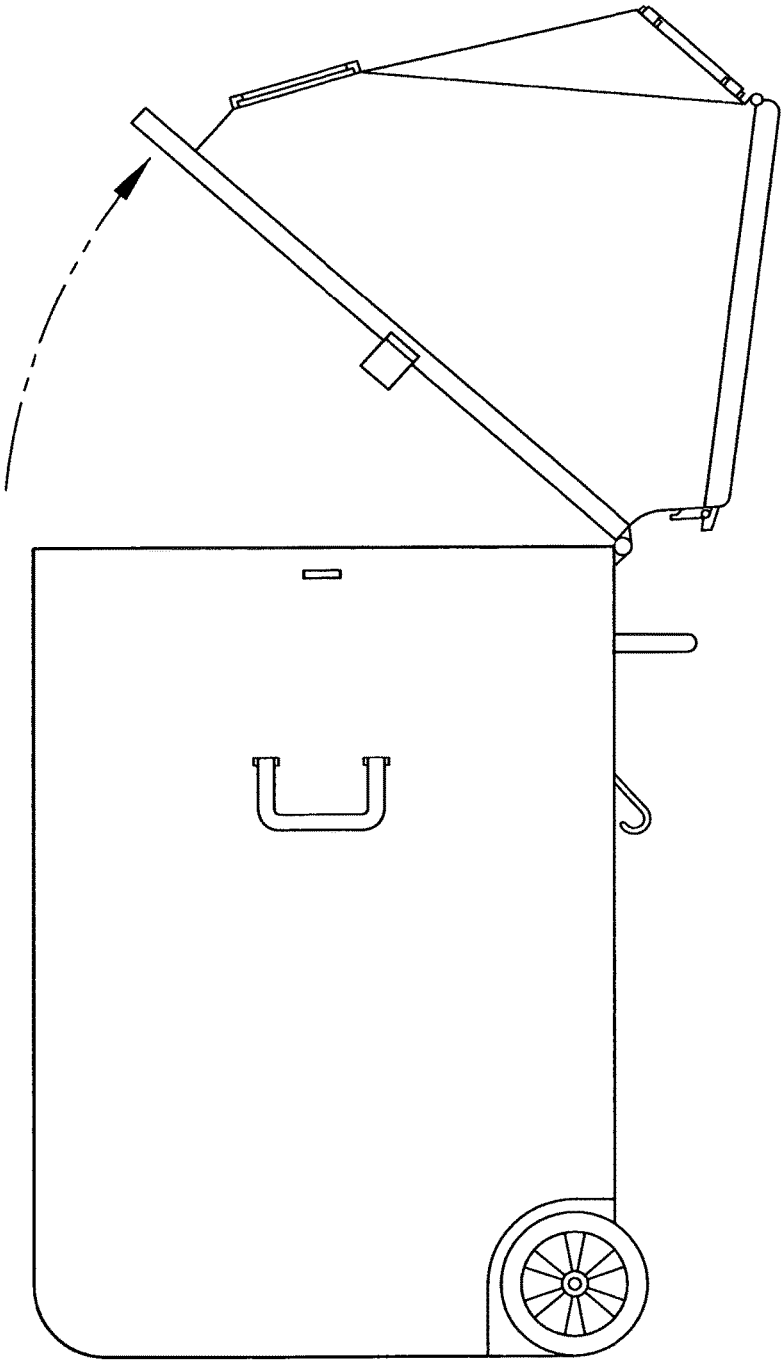
FIG. 5 is a right side elevation view.
Figure 6:
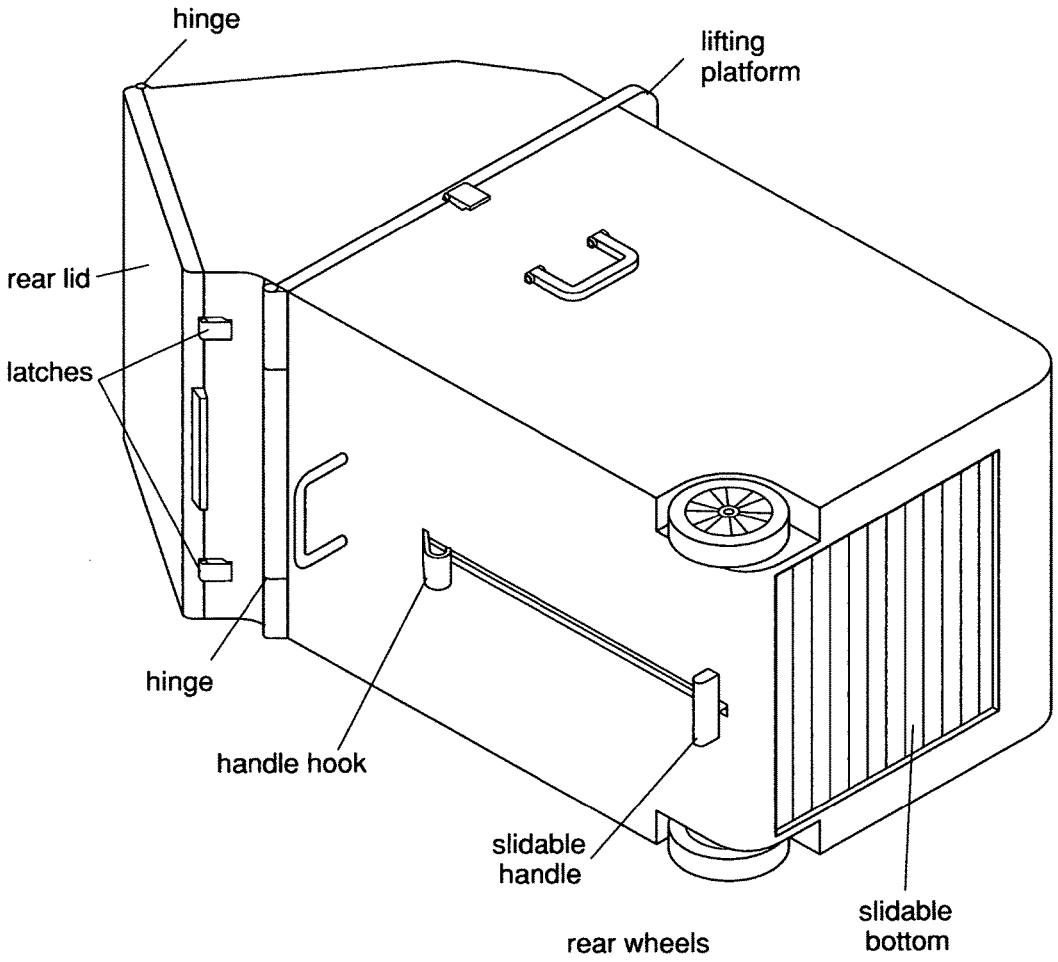
FIG. 6 is a bottom side back side perspective view, the accordion door closed.

With reference now to the drawings, and in particular FIGS. 1 through 6 thereof, an example of the garbage bin device employing the principles and concepts of the present garbage bin device and generally designated by the reference number 10 will be described.

Referring to FIGS. 1 through 6, the garbage bin device 10 comprises a bottom section 20 having a front side 22 spaced apart from a back side 23, a left side 24 spaced apart from a right side 25, and a top side 26 spaced apart from a bottom side 27. A pair of rounded corners 29 is disposed proximal each of the front side 22, the bottom side 27, and the right side 25, and proximal each of the front side 22, the bottom side 27, and the left side 24. A first wheel recess 34 is provided proximal each of the bottom side 27, the back side 23, and the right side 25, and a second wheel recess 34 is provided proximal each of the bottom side 27, the back side 23, and the left side 24. A wheel 35 is disposed in each of the wheel recesses 34. Each wheel 35 protrudes beyond the back side 23.

A plurality of pivoting handles 30 is provided. Each pivoting handle 30 is disposed more proximal the top side 26 than the bottom side 27. A bottom opening 32 is disposed in the bottom side 27. An L-shaped channel 40 is disposed around the bottom opening 32 and extended upwardly within the back side 23. A rounded section 41 is disposed within the L-shaped channel 40 between the back side 23 and the bottom side 27. An accordion door 48 is slidably disposed within the L-shaped channel 40. A handle slot 44 is disposed vertically within the back side 23 proximal the bottom side 27 and upwardly therefrom. A t-handle 46 is pivotally connected within the handle slot 44 to the accordion door 48. The t-handle 46 is disposed within the back side 23. A pair of handle hooks 47 is disposed above the handle slot 44, with the pair of handle hooks 47 in selective receipt of the t-handle 46 and holding the accordion door 48 open as desired.

A lid section 50 is disposed atop the bottom section 20. The lid section 40 has a lid top 51 spaced apart from a lid bottom 52, a lid front 53 spaced apart a lid back 54, and a lid left side 55 spaced apart from a lid right side 56. A lid overlap 57 extends outwardly beyond the top side 26. A lifting platform 58 is disposed above the front side 22. The lifting platform 58 is disposed more outwardly than the lid overlap 57 from the bottom section 20. At least one latch 80 selectively secures the lid bottom 52 to the top side 26. A front riser 60 is spaced apart from a curved rear riser 59. The front riser 60 and the rear riser 62 are disposed above the lid bottom 52. The front riser 60 is disposed above the front side 22. The rear riser 59 is disposed above the back side 23. A front slant 63 is disposed upon the front riser 60. The front slant 63 is angled to the lid back 54 and the lid top 51. The front slant 63 has a frame 61 with an indicium 62 therein.

A front gable 66 is disposed upon the front slant 63 and the lid front 53. A pivoting handle 30 is disposed atop the front gable 66. A rear slant 64 is disposed atop the rearwardly curved rear riser 62. The rear slant 64 meets the front slant 62 at the lid top 51. A rear top 69 is disposed atop the rear slant 64. The rear top 69 hingedly attaches to the front slant 62 at the lid top 51. The rear top 69 has a rear top overlap 70 disposed over the rear slant 64. At least one latch 80 selectively secures the rear top 69 to the rear slant 64 such that the rear top 69 is lifted selectively.

Johnson

10 garbage bin device
20 bottom section
22 front side
23 back side
24 left side
25 right side
26 top side
27 bottom side
29 rounded corner—pair, then an each one
30 handle—pivoting
32 bottom opening
34 wheel recess
35 wheel
40 L-shaped channel
41 rounded section
44 handle slot
46 t-handle
47 handle hooks
48 accordion door
50 lid section
51 lid top
52 lid bottom
53 lid front
54 lid back
55 lid left side
56 lid right side
57 lid overlap
58 lifting platform
59 curved rear riser
60 front riser
61 frame
62 indicium
63 front slant
64 rear slant
66 front gable
69 rear top
70 rear top overlap—hingedly disposed atop
80 latch

What I claim is:

1. A garbage bin device comprising:

a bottom section having a front side spaced apart from a back side, a left side spaced apart from a right side, a top side spaced apart from a bottom side, a pair of rounded corners, a first wheel recess, and a second wheel recess, wherein one of the pair of rounded corners is disposed proximal each of the front side, the bottom side, and the left side, and a second of the pair of rounded corners is disposed proximal each of the front side, the bottom side, and the right side, wherein the first wheel recess is disposed proximal each of the bottom side, the back side, and the right side, and the second wheel recess is disposed proximal each of the bottom side, the back side, and the left side;

a wheel disposed in each of the first wheel recess and the second recess, wherein the wheel protrudes beyond the back side;

a pivoting handle disposed on each of the left side and the right side, wherein the pivoting handle is disposed more proximal the top side than the bottom side;

a lid section disposed atop the bottom section, the lid section having a lid top spaced apart from a lid bottom, a lid front spaced apart a lid back, a lid left side spaced apart from a lid right side, a lid overlap extended beyond the top side, a lifting platform disposed above the front side, wherein the lifting platform is disposed more outwardly than the overlap from the bottom section;

at least one latch selectively securing the lid bottom to the top side;

a front riser spaced apart from a curved rear riser, wherein each of the front riser and the rear riser is disposed above the lid bottom, wherein the front riser is disposed above the front side and the rear riser is disposed above the back side;

a front slant disposed upon the front riser, the front slant angled to the lid back and the lid top, the front slant having a frame with an indicium therein;

a front gable disposed upon the front slant and the lid front;

a pivoting handle disposed atop the front gable;

a rear slant disposed atop the curved rear riser, the rear slant meeting the front slant at the lid top;

a rear top disposed atop the rear slant, the rear top hingedly attached to the front slant at the lid top, the rear top having a rear top overlap disposed over the rear slant; and at least one latch selectively securing the rear top to the rear slant.

2. A garbage bin device comprising:

a bottom section having a front side spaced apart from a back side, a left side spaced apart from a right side, a top side spaced apart from a bottom side, a pair of rounded corners, a first wheel recess, and a second wheel recess, wherein one of the pair of rounded corners is disposed proximal each of the front side, the bottom side, and the left side, and a second of the pair of rounded corners is disposed proximal each of the front side, the bottom side, and the right side, wherein the first wheel recess is disposed proximal each of the bottom side, the back side, and the right side, and the second wheel recess is disposed proximal each of the bottom side, the back side, and the left side;

a wheel disposed in each wheel recess, wherein the wheel protrudes beyond the back side;

a pivoting handle disposed on each of the left side and the right side, wherein the pivoting handle is disposed more proximal the top side than the bottom side;

a bottom opening disposed in the bottom side;

an L-shaped channel disposed around the bottom opening and extended upwardly within the back side;

a rounded section disposed within the L-shaped channel between the back side and the bottom side;

an accordion door slidably disposed within the L-shaped channel;

a handle slot disposed vertically within the back side proximal the bottom side and upwardly therefrom;

a t-handle pivotally connected through the handle slot to the accordion door, the t-handle disposed without the back side;

a pair of handle hooks disposed on the back side above the handle slot, the handle hooks in selective receipt of the t-handle;

a lid section disposed atop the bottom section, the lid section having a lid top spaced apart from a lid bottom, a lid front spaced apart a lid back, a lid left side spaced apart from a lid right side, a lid overlap extended beyond the top side, a lifting platform disposed above the front side, the lifting platform disposed more outwardly then the overlap from the bottom section;

at least one latch selectively securing the lid bottom to the top side;

a front riser spaced apart from a curved rear riser, each of the front riser and the rear riser disposed above the lid bottom, wherein the front riser is disposed above the front side and the rear riser is disposed above the back side;

a front slant disposed upon the front riser, the front slant angled to the lid back and the lid top, the front slant having a frame with an indicium therein;

a front gable disposed upon the front slant and the lid front;

a pivoting handle disposed atop the front gable;

a rear slant disposed atop the curved rear riser, the rear slant meeting the front slant at the lid top;

a rear top disposed atop the rear slant, the rear top hingedly attached to the front slant at the lid top, the rear top having a rear top overlap disposed over the rear slant; and at least one latch selectively securing the rear top to the rear slant.

* * * * *